United States Patent [19]

Irigoyen

[11] Patent Number: 4,883,077

[45] Date of Patent: Nov. 28, 1989

[54] APPARATUS FOR TRANSPORTING AND TREATING PARTICLES OF TOBACCO AND THE LIKE

[75] Inventor: Pierre Irigoyen, Vert Saint Denis, France

[73] Assignee: Decouflé s.a.r.l., Chilly-Mazarin, France

[21] Appl. No.: 130,400

[22] Filed: Dec. 9, 1987

[30] Foreign Application Priority Data

Dec. 11, 1986 [FR] France ..... 86 17363

[51] Int. Cl.[4] ..... A24B 7/14

[52] U.S. Cl. ..... 131/108; 131/109.1; 131/109.2; 131/109.3; 131/110; 131/84.3; 131/296

[58] Field of Search ..... 131/108, 109.1, 109.2, 131/109.3, 110, 84.3, 296

[56] References Cited

U.S. PATENT DOCUMENTS 4,523,598 6/1985 Weiss et al. ..... 131/296

4,697,604 10/1987 Brown et al. ..... 131/296

*Primary Examiner*—V. Millin

*Attorney, Agent, or Firm*—Peter K. Kontler

[57] ABSTRACT

A stream of air is circulated by a blower along an endless path a portion of which is defined by an upright duct having an air inlet at its lower end, an air outlet at its upper end, and an inlet for comminuted tobacco particles intermediate its air inlet and air outlet. The particles of tobacco which are admitted into the duct are classified according to weight by the ascending air stream which advances satisfactory particles toward the outlet where the particles are attracted to a driven foraminous belt conveyor to form a growing tobacco stream. The air inlet of the duct contains a rotary impeller which distributes the inflowing air across the full width of the duct so that the thus formed air stream ensures a predictable classifying action and the formation of a homogeneous shower of satisfactory particles which are advanced toward the stream growing zone.

10 Claims, 1 Drawing Sheet

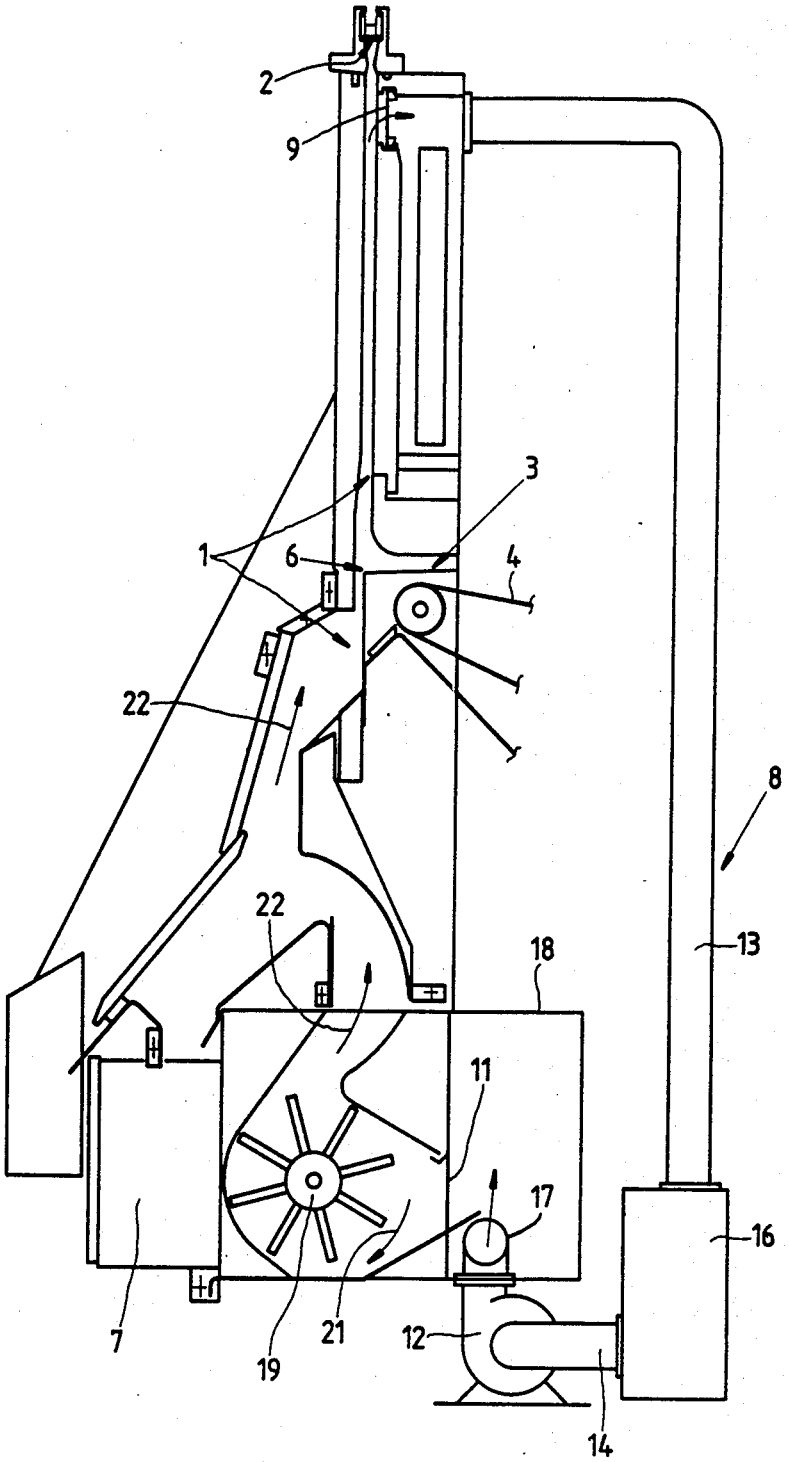
2
9
3
1
6
4
22
8
22
18
13
11
17
16
7
19
21
12
14

APPARATUS FOR TRANSPORTING AND TREATING PARTICLES OF TOBACCO AND THE LIKE

BACKGROUND OF THE INVENTION

The invention relates to improvements in apparatus for transporting and treating fibrous materials, such as particles of natural, substitute or reconstituted tobacco, fibrous filter material for tobacco smoke and the like. More particularly, the invention relates to improvements in apparatus which can be utilized in so-called distributors or hoppers of machines for making cigarette rods, cigar rods, cigarillo rods, rods of fibrous filter material and like products of the tobacco processing industry.

It is well known to employ air as a carrier medium for tobacco and other particulate materials which are used in the tobacco processing industry. For example, an air stream can be used to transport a shower of tobacco particles toward a foraminous belt conveyor which gathers a growing tobacco stream for advancement toward and through a trimming or equalizing station where the surplus of tobacco is removed and the remainder of the stream is ready to be converted into a rod-like filler. It is further known to employ streams of air as a means for transporting comminuted tobacco leaves or the like through a classifying or sifting zone where the satisfactory particles (such as shreds of tobacco leaf laminae) are segregated from unsatisfactory constituents, e.g., from relatively heavy and large fragments of tobacco ribs which would be likely to puncture a wrapper of cigarette paper or the like. Air can be used to convey particles of tobacco or the like in the form of a stream (e.g., by causing the particles to adhere to one side of a foraminous belt conveyor or to the periphery of a foraminous drum-shaped conveyor) or in the form of a shower, e.g., by causing the particles to rise with an ascending air stream.

OBJECTS AND SUMMARY OF THE INVENTION

An object of the invention is to provide an apparatus wherein fragments of tobacco or other fibrous material for use in the tobacco processing industry can be conveyed, classified and/or otherwise treated by flowing air in a novel and improved way.

Another object of the invention is to provide a distributor or hopper which embodies the above outlined apparatus.

A further object of the invention is to provide the apparatus with novel and improved means for delivering a homogeneous mass of fibrous material to a station where the mass is converted into a growing stream of comminuted tobacco leaves or the like.

An additional object of the invention is to provide an apparatus wherein one and the same flow of a gaseous carrier medium can be used again and again to convey and otherwise treat a mass of fibrous material.

Still another object of the invention is to provide a novel and improved method of transporting and simultaneously classifying fragments of tobacco leaves or the like in a small area and with a high degree of reliability.

A further object of the invention is to provide a novel and improved apparatus for the making of a continuous and highly homogeneous stream of comminuted tobacco leaves or other fibrous material which is used in the tobacco processing industry.

The invention is embodied in an apparatus for transporting and treating particles of tobacco and analogous fibrous materials (including natural tobacco, reconstituted tobacco, substitute tobacco, filter material for tobacco smoke and the like) in a rod making machine of the tobacco processing industry (e.g., in a cigarette maker). The apparatus comprises a duct having an air admitting first inlet, an air outlet which is remote from the inlet, and a second inlet intermediate the first inlet and the outlet. The apparatus further comprises means for evacuating air from the duct by way of the outlet, means for admitting air into the duct by way of the first inlet so that a steam of air flows from the first inlet, past the second inlet and toward the outlet, and means (e.g., an endless belt conveyor) for feeding into the duct by way of the second inlet fibrous material which contains lighter and heavier components (e.g., shreds of tobacco leaf laminae and fragments of tobacco ribs) so that the air stream entrains at least the lighter components from the second inlet toward the outlet.

The apparatus preferably further comprises means for distributing the air stream across the duct in the region of the first inlet, i.e., ahead of the second inlet). The duct preferably defines a relatively wide path for the flow of the air stream from the first inlet to the outlet, and the distributing means can comprise means for spreading the air stream at least substantially across the full width of the path. In accordance with a presently preferred embodiment of the invention, the distributing means comprises a rotary impeller in the form of a cell wheel which extends substantially transversely of the direction of flow of the air stream from the first inlet toward the outlet, and such impeller can comprise a plurality of blades. For example, the impeller can comprise an elongated rotary hub and the blades are disposed in planes which extend substantially radially of and in parallelism with the axis of rotation of the hub.

The evacuating means can include means for supplying air from the outlet of the duct to the air admitting means so that the air stream is circulated along an endless path a portion of which is defined by the duct.

The outlet of the duct is preferably disposed at a level above the inlets, and the second inlet is disposed at a level above the first inlet, at least if the duct is a substantially upright duct. Thus, the air stream then flows upwardly from the first inlet to classify the admitted fibrous material in the region of the second inlet and to thereupon entrain at least the lighter particles or components of the admitted fibrous material upwardly and toward the outlet of the duct. In other words, those particles which are acceptable for processing to form a stream of tobacco or the like rise in the duct into the range of suitable withdrawing means (such as an endless foraminous belt conveyor or a foraminous drum-shaped conveyor) which serves to gather and remove the lifted particles from the duct in the region of the outlet.

The apparatus can comprise an air blower having an intake which constitutes or includes the aforementioned air evacuating means, and an outlet which constitutes or includes the air admitting means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a schematic partly elevational and partly vertical sectional view of an apparatus which embodies one form of the invention and employs a vertical duct with the air inlet at the lower end, the air outlet at the upper end, and an inlet for fibrous material at a level between the air inlet and the air outlet.

DESCRIPTION OF THE PREFERRED EMBODIMENTS

The drawing shows an apparatus which forms part of a distributor (also called hopper) in a cigarette rod making machine. The apparatus includes an upright duct 1 which defines a relatively wide path for the flow of an air stream 22 in directions indicated by arrows, namely from a first inlet 11 at the lower end of the duct, past a second inlet 3 at a level above the inlet 11, and toward and into an outlet 9 at the upper end of the duct, i.e., above the inlets 11 and 3. The inlet 3 is adjacent a classifying zone 6 into which an endless belt conveyor 4 feeds a wide layer of tobacco particles (e.g., a mixture of lighter components in the form of shredded tobacco leaf laminae and heavier components in the form of fragments of tobacco ribs) across the path which is defined by the duct 1 so that at least the lighter components rise with the air stream from the inlet 3 toward the outlet 9. The unacceptable (too heavy) components of admitted fibrous material descend counter to the direction of upward flow of the air stream 22 and accumulate in a collecting receptacle 7. A baffle in the lower portion of the duct 1 diverts the descending heavier components of fibrous material from the inlet 11 in a direction toward the open upper end of the collecting receptacle 7.

The means for withdrawing acceptable components of fibrous material from the upper end portion of the duct 1 in the region of the air outlet 9 comprises an endless foraminous belt conveyor 2 having a lower reach travelling beneath a suction chamber so that the ascending fibrous material forms a growing stream of fibrous material at the underside of the lower reach and such stream is thereupon equalized and processed to constitute the filler of a wrapped rod which is ready to be subdivided into a file of discrete plain cigarettes or other rod-shaped articles of the tobacco processing industry. Reference may be had, for example, to U.S. Pat. No. 4,306,573 granted Dec. 22, 1981 to Willy Rudszinat for "Method and apparatus for producing rod-like tobacco fillers" which fully describes and shows the manner of converting a growing stream of tobacco or analogous fibrous material into a continuous rod-like filler and of converting the filler and a web of cigarette paper or other suitable wrapping material into a continuous rod which is then severed at desired intervals to yield plain cigarettes, cigarillos or cigars of unit length or multiple unit length.

The belt conveyor 4 is relatively wide (as considered at right angles to the plane of the drawing) so as to ensure that it feeds fibrous material across the full width of the path which is defined by the duct 1 in the region of the inlet 3. On the other hand, the belt conveyor 2 is relatively narrow and its lower reach travels at right angles to the plane of the drawing so as to convey the growing stream of classified fibrous material toward or away from the observer of the drawing.

The means for admitting air into the inlet 11 of the duct 1 comprises the outlet of a blower 12, and such outlet comprises a compressed air conduit 17 as well as an air box 18 which receives compressed air from the conduit 17 and admits air into the inlet 11.

The means for evacuating air from the duct 1 by way of the outlet 9 comprises an intake 8 including a first conduit 13 connected to the outlet 9, a filter 16 which receives evacuated air from the conduit 13, and a further conduit 14 which is connected to the housing of the blower 12. The latter causes the air stream to circulate along an endless path a portion of which (between the inlet 11 and the outlet 9) is defined by the duct 1. The exact construction of the blower 12 forms no part of the invention. It is clear that the means for evacuating air from the outlet 9 of the duct 1 can comprise a suction generating device in the form of a pump or blower, and that the means for admitting air into the inlet 11 of the duct 1 can comprise a discrete blower which need not draw air from the outlet 9. The illustrated air circulating system is preferred at this time because it saves energy and its space requirements are relatively low.

In accordance with a further feature of the invention, the apparatus comprises means for distributing the air stream 22 across the full width of the path which is defined by the duct 1. Such distributing means comprises a rotary impeller 19 in the form of a cell wheel which is installed in or downstream of the air inlet 11 (but upstream of the inlet 3) so as to rotate in the direction of arrow 21 and to spread the inflowing air at right angles to the plane of the drawing to thereby ensure that the air stream which flows through the classifying zone 6 constitutes a relatively thin layer or curtain which entrains satisfactory components of fibrous material toward the conveyor 2 but allows the unsatisfactory components to descend into the collecting receptacle 7. The illustrated impeller 19 has a cylindrical hub which rotates about a substantially horizontal axis substantially transversely of the direction of air flow in the duct 1, and a set of equidistant blades or vanes which are disposed in planes extending radially of and in the axial direction of the hub to propel the inflowing air stream in the direction of arrow 21 and thereupon upwardly toward and past the inlet 3 for fibrous material. The impeller 19 contributes to uniformity of the classifying action in the zone 6 and to the formation of a shower of satisfactory components of fibrous material which ascends toward and gathers into a growing stream at the underside of the lower reach of the conveyor 2.

An important advantage of the improved apparatus is that it enhances the classifying action in the region (6) immediately adjacent the locus (inlet 3) of introduction of fibrous material into the duct 1, and that the apparatus also ensures the formation of a homogoneous stream of fibrous material which is transported by the conveyor 2 and can be converted into a highly satisfactory filler, i.e., into the draped portion of a cigarette rod or the like.

Another important advantage of the improved apparatus is its simplicity. Thus, a single blower 12 will normally suffice to circulate the air stream along an endless path, and the relatively simple and inexpensive impeller 19 (whose hub can be driven by the motor for the blower 12, by admitted compressed air or by a discrete motor) ensures highly satisfactory distribution of the air stream 22 across the full width of the path which is defined by the duct 1 to thus ensure reliable classification of supplied fibrous material as well as the formation of a stream which grows in a predictable fashion and exhibits a surprisingly high degree of homogeneousness.

The manner in which the belt conveyor 4 receives fibrous material from a magazine or the like (not shown) is well known in the art. Reference may be had, for example, to U.S. Pat. No. 4,185,644 granted Jan. 29, 1980 to Uwe Heitmann et al. for "Distributor for cigarette makers or the like".

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for transporting and treating particles of tobacco and analogous fibrous material in a rod making machine of the tobacco processing industry, comprising a duct having an air admitting first inlet, an air outlet remote from said inlet, and a second inlet intermediate said first inlet and said outlet; means for evacuating air from said duct by way of said outlet; means for admitting air into said first inlet so that a stream of air flows from said first inlet, past said second inlet and toward said outlet; means for distributing the air stream across the duct in the region of said first inlet, including a rotary impeller extending substantially transversely of the direction of flow of the air stream from said first inlet toward said outlet; and means for feeding into said duct by way of said second inlet fibrous material containing lighter and heavier components so that the stream entrains at least the lighter components from said second inlet to said outlet.

2. The apparatus of claim 1, wherein said duct defines a relatively wide path for the flow of air from said first inlet to said outlet and said distributing means is operative to spread the air stream at least substantially across the full width of said path.

3. The apparatus of claim 1, wherein said impeller has a plurality of blades.

4. The apparatus of claim 3, wherein said impeller has an elongated hub and said blades are disposed in planes extending substantially radially of and in substantial parallelism with the axis of said hub.

5. The apparatus of claim 1, wherein said evacuating means includes means for supplying air from said outlet to said admitting means so that the air stream is circulated along an endless path a portion of which is defined by said duct.

6. The apparatus of claim 1, wherein said outlet is disposed at a level above said inlets.

7. The apparatus of claim 6, wherein said duct is a substantially upright duct and said second inlet is located above said first inlet so that the lighter components of fibrous material rise with the air stream from said second inlet toward said outlet.

8. The apparatus of claim 1, further comprising means for withdrawing fibrous material from said duct in the region of said outlet.

9. The apparatus of claim 8, wherein said withdrawing means comprises a foraminous conveyor.

10. The apparatus of claim 1, further comprising an air blower having an intake constituting or forming part of said evacuating means and an outlet constituting or forming part of said admitting means.

* * * * *